US010550679B2

(12) United States Patent
Redman et al.

(10) Patent No.: US 10,550,679 B2
(45) Date of Patent: Feb. 4, 2020

(54) DEPRESSURIZING OIL RESERVOIRS FOR SAGD

(71) Applicant: ConocoPhillips Company, Houston, TX (US)

(72) Inventors: Robert S Redman, Houston, TX (US); Siluni L. Gamage, Houston, TX (US); T. J. Wheeler, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 15/948,460

(22) Filed: Apr. 9, 2018

(65) Prior Publication Data

US 2018/0313197 A1 Nov. 1, 2018

Related U.S. Application Data

(60) Provisional application No. 62/491,232, filed on Apr. 27, 2017.

(51) Int. Cl.

| | |
|---|---|
| ***E21B 43/24*** | (2006.01) |
| ***E21B 43/16*** | (2006.01) |
| *E21B 47/06* | (2012.01) |

(52) U.S. Cl.
CPC ..... *E21B 43/2408* (2013.01); *E21B 43/168* (2013.01); *E21B 43/2401* (2013.01); *E21B 47/065* (2013.01)

(58) Field of Classification Search
None
See application file for complete search history.

(56) References Cited

U.S. PATENT DOCUMENTS

| | | | |
|---|---|---|---|
| 6,353,706 | B1 | 3/2002 | Bridges |
| 7,069,993 | B2 | 7/2006 | Hill |
| 8,265,468 | B2 | 9/2012 | Carr, Sr. |

(Continued)

FOREIGN PATENT DOCUMENTS

| | | |
|---|---|---|
| CA | 2235085 | 10/1999 |

OTHER PUBLICATIONS

Rangel-German, et al., "Electrical-heating-assisted recovery for heavy oil," J. Pet. Sci. Eng. 45:213-31 (2004).

(Continued)

*Primary Examiner* — Anuradha Ahuja
(74) *Attorney, Agent, or Firm* — Boulware & Valoir

(57) ABSTRACT

A proposed methodology to startup wells with electrical downhole heating as a preconditioning method for a steam injection process. The downhole electrical heating recovers oil which results in a reduction in the reservoir pressure. Once oil has been recovered for a period of time and the operating pressure and temperature has been reduced, SAGD well pairs are provided between the downhole heater wells, and SAGD or a SAGD-like method used to produce oil. The method reduces heat losses due to steam injection at lower pressure and temperature and therefore, improves efficiency and lowers operating costs. Operating at lower pressure and temperature will also reduce the risk of melting the permafrost and consequent well failure issues. When oil production drops below an economical level, remaining oil can be collected at the DHH wells using the SAGD wellpair for gas or solvent or steam sweeps, or combinations thereof.

18 Claims, 6 Drawing Sheets

(56) References Cited

U.S. PATENT DOCUMENTS

| | | | | |
|---|---|---|---|---|
| 2009/0139716 | A1 | 6/2009 | Brock et al. | |
| 2010/0258309 | A1* | 10/2010 | Ayodele | E21B 43/243 166/272.3 |
| 2011/0186292 | A1* | 8/2011 | Wheeler | E21B 43/24 166/272.3 |
| 2011/0303423 | A1 | 12/2011 | Kaminsky et al. | |
| 2014/0345861 | A1 | 11/2014 | Stalder et al. | |
| 2015/0041128 | A1* | 2/2015 | Hytken | E21B 43/126 166/272.3 |
| 2015/0198012 | A1 | 7/2015 | Mills et al. | |
| 2017/0298718 | A1* | 10/2017 | Mills | E21B 23/10 |

OTHER PUBLICATIONS

International Search Report for related case, App. No. PCT/US2018/026709, dated Jun. 15, 2018.

* cited by examiner

DEPRESSURIZING OIL RESERVOIRS FOR SAGD

PRIORITY CLAIM

This application claims priority to U.S. Provisional Application Ser. No. 62/491,232, filed Apr. 27, 2017, and expressly incorporated by reference in its entirety for all purposes.

FIELD OF THE DISCLOSURE

This invention relates generally to methods of depressurizing heavy oil wells for subsequent more efficient SAGD. This new method uses electric inline heaters and producer wells to lower the pressure in a reservoir, at which time SAGD wellpairs can be initiated.

BACKGROUND OF THE DISCLOSURE

Bitumen is a thick, sticky form of crude oil, so heavy and viscous (thick) that it will not flow unless heated or diluted with lighter hydrocarbons. At room temperature, bitumen is much like cold molasses. Often times, the viscosity can be in excess of 1,000,000 cP.

Due to their high viscosity, these heavy oils are hard to mobilize, and they generally must be made to flow by adding heat in order to produce and transport them. One common way to heat bitumen is by injecting steam into the reservoir. Steam Assisted Gravity Drainage (SAGD) is the most extensively used technique for in situ recovery of bitumen resources in the McMurray Formation in the Alberta Oil Sands.

In a typical SAGD process, shown in FIG. 1, two horizontal wells are vertically spaced by 4 to 10 meters (m). The production well is located near the bottom of the pay and the steam injection well is located directly above and parallel to the production well. In SAGD, a "startup" or "preheat" period is required before production can begin. The typical startup lasts 3-6 months, and during that time, steam is injected continuously into both wells until the two wells are in fluid communication. At that time, the lower well is converted over to a producer, and steam is injected only into the injection well, where it continues to rise in the reservoir and form a steam chamber.

With continuous steam injection, the steam chamber will continue to grow upward and laterally into the surrounding formation. At the interface between the steam chamber and cold oil, steam condenses and heat is transferred to the surrounding oil. This heated oil mobilizes and drains, together with the condensed water from the steam, into the production well due to gravity.

This use of gravity gives SAGD an advantage over conventional steam injection methods. SAGD employs gravity as the driving force and the heated oil remains warm and mobile when draining toward the production well. In contrast, conventional steam injection displaces oil to a cold area, where its viscosity increases and the oil mobility is again reduced.

Conventional SAGD tends to develop a cylindrical steam chamber with a somewhat tear drop or inverted triangular cross section. With several SAGD well pairs operating side by side, the steam chambers tend to coalesce near the top of the pay, leaving the lower "wedge" shaped regions midway between the steam chambers to be drained more slowly, if at all. Operators may install additional producing wells in these midway regions to accelerate recovery, as shown in FIG. 2, and such wells are called "infill" wells, filling in the area where oil would normally be stranded between SAGD well-pairs.

Although quite successful, SAGD does require enormous amounts of water in order to generate a barrel of oil. Some estimates provide that 1 barrel of oil from the Athabasca oil sands requires on average 2 to 3 barrels of water (cold water equivalent), although with recycling the total amount can be reduced to 0.5 barrel. In addition to using a precious resource, additional costs are added to convert those barrels of water to high quality steam for downhole injection. Therefore, any technology that can reduce water or steam consumption has the potential to have significant positive environmental and cost impacts.

Another problem with steam-based methods is that they may not be appropriate for use in the Artic, where injecting large amounts of steam for years on end has high potential to melt the permafrost, allowing pad equipment and wells to sink, with potentially catastrophic consequences. Indeed, the media is already reporting the slow sinking of Artic cities due to global warming, and cracking and collapsing homes are a growing problem in cities such as Norilsk in northern Russia.

Therefore, although beneficial, the SAGD concept could be further developed to address some of these disadvantages or uncertainties. In particular, a method that reduces steam use would be beneficial, especially for Arctic tundra environments, where steam based methods may be hazardous or impractical.

SUMMARY OF THE DISCLOSURE

Current SAGD practice involves arranging horizontal production wells low in the reservoir pay interval and horizontal steam injection wells approximately 3-10 meters above (usually about 4-5) and parallel to the producing wells. Well pairs may be spaced between 50 and 150 meters laterally from one another in parallel sets to extend drainage across reservoir areas developed from a single surface drilling pad.

Typically, both production and injection wells are preheated by circulating steam from the surface down a toe tubing string that ends near the toe of the horizontal liner; steam condensate returns through the tubing-liner annulus to a heel tubing string that ends near the liner hanger and flows back to the surface through this heel tubing string. After such a period of "startup" circulation in both the producer and the injector wells for a period of about 3-6 months, the two wells will reach fluid communication. The reservoir midway between the injector and producer wells will reach a temperature high enough (50-100° C.) so that the bitumen becomes mobile and can drain by gravity downward, while live steam vapor ascends by the same gravity forces to establish a steam chamber. At this time, the wellpair is placed into SAGD operation with injection only in the upper well and production from the lower well, and production can begin. SAGD operations target a producing oil viscosity of approximately 10 cp as shown in FIG. 4.

Previous studies have shown that a SAGD process could produce high oil recoveries in the Ugnu reservoir, which is a heavy oil reservoir in Alaska. However, Ugnu reservoir is at about a 3000 ft depth where steam injection would need to be conducted at very high pressure and temperatures—exceeding 300° C. The extreme depth reduces the amount of latent heat that is available in the steam to mobilize the oil. Operating at high depths will result in higher heat losses, even when vacuum insulated tubing (VIT) is used and could also cause issues with delivering high quality steam to the heel of the horizontal well. These inefficiencies will result in higher operating costs and lower oil recoveries. Furthermore, prolonged use of high temperature steam presents significant risk of melting the permafrost, resulting in well subsidence and well failure issues.

Instead of steam use for startup, we propose the use of downhole electric heating be used in one or more producer wells, preferably an array of producer wells, to reduce the oil viscosity and lower the operating pressure and operating temperature for the subsequent SAGD wellpairs. Using downhole heating and producing oil reduces the pressure in the area surrounding the producer well, once the natural drive provided by fluid expansion and solution gas drive has been diminished. Once heating is discontinued or slowed, temperature will also reduce. Note, that even though natural drive contributes to oil production during the preheating period, typically some artificial lift is still required during this stage.

This "preconditioning" method used until the pressure is "substantially reduced." For example, initial reservoir pressure, using a gradient of ~0.465 psi/ft would be ~1400 psi for the Ugnu (depth of 3000 ft). We prefer to reduce the near wellbore region down to about half that (about 50%) to allow us to operate in the 250° C. range. This would allow us to start the SAGD process at the lower temperature. However, the percentage drawdown will depend on the depth of the reservoir. Thus, "substantially reduced" means at least a 20% decrease, and may be more (>30%, >40%, >50%) depending on depth, pressures and temperatures.

Once the pressure is substantially reduced, the method is then followed with a more traditional SAGD wellpair, situated adjacent the original producer or between pairs of original producers. Drilling two downhole heater (DHH) wells offset to a SAGD wellpair and producing the DHH wells on primary production will lower the reservoir pressure prior to initiating SAGD operations. This can improve SAGD efficiency, allow initial installation of an electric submersible pump (ESP) in the SAGD producer, and allow for SAGD operations at temperatures below 200-250° C. (392-482° F.). In the Alaska Ugnu Oil field, the lower production and injection temperature can improve well integrity by reducing the risk of permafrost melt leading to wellbore subsidence.

Other variant steam-based or steam-and-gas-based or steam-and-solvent-based methods for oil production could also be used, such as expanding solvent SAGD (ES-SAGD) aka solvent assisted SAGD (SA-SAGD), low pressure SAGD (LP-SAGD); steam drive aka steam flooding, cyclic steam stimulation (CSS) aka "huff-and-puff", Steam and Gas Push (SAGP), and the like.

The final well array seems superficially similar to the use of infill wells, but in fact they are quite different because infill wells are used after SAGD to capture the stranded wedge oil between adjacent steam chambers and often an ESP must be used since the natural drive may have long since been diminished. Here, the DHH wells are used before SAGD to produce oil. After SAGD has produced as much oil as it can, steam sweeps can also be used to capture any remaining oil.

The method requires that electrically heated producers low in the pay be used for production until reservoir pressure is reduced. At that time, traditional SAGD wellpairs are drilled between the DHH wells. A SAGD startup is initiated, but may take less time, since heat has already been introduced to the reservoir. Once the SAGD wellpairs are in fluid communication, the lower well of the wellpair is converted to production, and steam injected only into the injector. During the SAGD process the depressurized reservoir operates more efficiently, with lower cumulative steam oil ratios. An ESP or some other method of artificial lift is used to bring oil to the surface during SAGD.

The DHH wells also provide additional production offtake points to improve steam sweep efficiency in the reservoir, taking advantage of viscous forces driving fluids from the SAGD wellpair to the DHH well. In fact, the DHH wells operate like infill wells, but they differ in that these DHH wells are used first (and can also be drilled first) for DHH production, and then can function again later in SAGD to collect the wedge oil. Infill wells, by contrast, are drilled and brought on production once a SAGD steam chamber has provided sufficient heat within the reservoir heating the bitumen around the infill well to temperatures of 50-80C. This is typically several years after the initial SAGD wellpair has been brought online.

As one alternative embodiment, the SAGD wells can be used later in the lifecycle of the reservoir for cyclic steam drive processes, driving any remaining oil to the original DHH wells.

Furthermore, this DHH well methodology could also be used as a preconditioning method for other thermal recovery processes, such as Expanding Solvent SAGD (ES-SAGD, aka Solvent Assisted Process or SAP-SAGD), enhanced SAGD (eSAGD, aka ES-SAGD) methods where steam and solvent(s) are injected into the reservoir together. The solvent(s) used in this method could also be the NGL mixes available in the North Slope of Alaska.

The electrical downhole heater can be any known in the art or to be developed. For example, the patent literature provides some examples: U.S. Pat. Nos. 7,069,993, 6,353,706 and 8,265,468. There are also commercially available downhole electric heaters. ANDMIR™, mineral insulated heaters, and the like.

One particularly useful example is the PETROTRACE™ by PENTAIR™. The typical system including a downhole electric heating cable, ESP electrical cable, power connection and end termination kits, clamping systems, temperature sensors, wellhead connectors and topside control and monitoring equipment. The cable has an operating temperature up to 122° F. (50° C.), provides up to 41 W/m, and is housed in a flexible armored polymer jacket, allowing for ease of installation on the outside of the production tube. Further, the cables are available in different sizes and power levels and in lengths of up to 3,937 ft (1,200 m). Advantageously, the heater can be configured so that more power and heat is delivered to the toe of a well. Heaters can also be deployed inside the outer casing, outside production tubing, in coiled tubing, outside of the casing, but preferably the heating cable lies outside the production tubing and/or in contact with the slotted liner.

Further, since the heating zone of an electric heater can be controlled by changing the conductivity/resistance and insulation of the wire, the method avoids high heat levels at the surface that are provided by steam-based methods. This is particularly useful where there is permafrost. In particular, Artic tundra wells may be less suitable for wholly-steam-based methods because the injection of steam from the surface tends to melt the permafrost, which can then allow pad equipment and tubing to become destabilized and even sink.

The invention can comprise any one or more of the following embodiments, in any combination:

In one embodiment, heavy oil is produced by providing downhole heater well(s) ("DHH well(s)") in a heavy oil reservoir where the DHH well(s) are configured for electric downhole heating with an electric heater and for producing heated heavy oil; heating the DHH well(s) with an electric heater and producing oil during a preconditioning period until pressure is reduced; providing a SAGD wellpair (with an upper well over a lower well), adjacent or between the DHH well(s); injecting steam into the SAGD wellpair until the upper and lower wells are in fluid communication; converting the lower (production) well to a producer well and injecting steam into the upper (injector) well; and producing oil. Preconditioning the reservoir with a DHH wells allows steam injection to occur at a lower temperature than would otherwise be required without preconditioning the reservoir.

In another embodiment, heavy oil is produced by: providing first and second DHH wells in a heavy oil reservoir at a first pressure, where the DHH wells are configured for electric downhole heating and oil production; heating the DHH wells with an electric heater and producing heavy oil at from the DHH wells for a preconditioning period until the pressure is reduced to a second pressure, lower than the first pressure; providing a horizontal wellpair between said DHH wells, where the wellpair has an upper injection well in fluid communication with a lower production well, and injecting steam into the upper injection well at a lower temperature than would otherwise be required without the preconditioning period and producing oil at the lower production well for a production period until oil production is reduced; converting said lower well to steam injection and injecting steam into both the upper and lower wells, thereby driving any remaining oil to the DHH wells and producing said remaining oil at the DHH wells.

In yet another embodiment, heavy oil is produced in a region of permafrost, by: drilling one or more DHH well(s) in a heavy oil reservoir in a region of permafrost, at a first temperature and pressure, where the DHH well(s) are configured for electric downhole heating using an electric heater and for oil production; heating the DHH wells with the electric heater to reduce viscosity of the heavy oil and producing the heavy oil at from the DHH well(s) until the pressure is reduced; discontinuing heating; drilling a SAGD wellpair adjacent or between one or more pairs of DHH well(s), and producing heavy oil using artificial lift and a steam based gravity drainage method for a SAGD production period until oil production is reduced; injecting steam into both wells of the SAGD wellpair to drive a remaining oil to one or more DHH well(s) and producing the remaining oil at the DHH well(s), wherein the risk of melting the permafrost is reduced as compared to a method not using the DHH wells for heating and producing.

The heating step may be discontinued after the preconditioning period or not, as desired. The electric heater may be an electric heater cable or mineral insulated heater deployed inside the DHH well(s).

Steam injection may be injection of steam or co-injection of steam plus a gas or solvent including gas-steam co-injection, solvent-steam co-injection, or a combination of gas-solvent-steam co-injection, or alternating injection with steam, gas, solvent, or combinations thereof. The solvent may be a natural gas liquid condensate produced at or near said DHH well(s). The solvent may be ethane, propane, butane, pentane, or mixtures of solvents. Any non-condensable gas may be used including $CO_2$, $N_2$, $CH_4$, natural gas, or gas mixtures.

The DHH well(s) and SAGD wellpair are typically laterally spaced 25-100 meters apart, preferably about 50-75 m, but may be spaced anywhere from 5 to 200 meters apart or greater.

In one embodiment, the lower well of the wellpair is again converted to steam injection when oil production is reduced, and steam is injected to both the upper and lower wells of the wellpair, driving the remaining oil to the DHH well(s). At any point an electric submersible pump or other lift mechanism may be used to lift oil to the surface.

"Vertical" drilling is the traditional type of drilling in oil and gas drilling industry, and includes well <45° of vertical.

"Horizontal" drilling is the same as vertical drilling until the "kickoff point" which is located just above the target oil or gas reservoir (pay zone), from that point deviating the drilling direction from the vertical to horizontal. By "horizontal" what is included is an angle within 45° (≤45°) of horizontal. All horizontal wells will have a vertical portion, but the majority of the well is within 45° of horizontal.

As used herein, "NGL" or natural gas liquids are components of natural gas that are separated from the gas state in the form of liquids. This separation occurs in a field facility or in a gas processing plant through absorption, condensation or other method. Natural gas liquids are classified based on their vapor pressure: Low=condensate, Intermediate=natural gas, High=liquefied petroleum gas. Examples of NGLs used herein include ethane, propane, butane, isobutane and pentane.

As used herein, it is understood that injecting "steam" may include some injection of hot water as the steam loses heat and condenses or a wet steam is used.

As used herein a "DHH well" or "downhole heater well" is a well low in the pay that is heated with an electric cable heater aka electric inline heater, and produced under primary drive until the drive is diminished, e.g., pressure is reduced. Such wells are typically horizontal.

As used herein, the "preconditioning period" is that time wherein the DHH well is heated and oil produced, until the initial P of the well is reduced.

As used herein, "operating pressure" is the pressure at which oil is produced during the steam based methods. "Operating temperature" also refers to the temperature at which oil is produced during the steam based methods. The P&T are typically higher during the preconditioning period than during the SAGD production period.

The term "SAGD production period" is that time after the preconditioning period where steam and gravity are used for oil production, and includes any of the variations on SAGD.

The term "traditional SAGD wellpair" refers to the typical horizontal wellpair wherein the injector is 4-10 meters more or less directly over a parallel producer low in the play.

The term "SAGD wellpair," however, includes variations, e.g., fishbone lateral SAGD arrangements, radial fishbone arrangements, multilateral arrangements where the injector may be laterally separated from the producer, passive FCD completions where the vertical separation can be less, and the like.

"Play" refers to the oil-bearing layers in a reservoir.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| | |
|---|---|
| SAGD | Steam assisted gravity Drainage |
| ESP | Electric submersible pump |
| DHH | Downhole heater |
| FCD | Flow control device |
| P | Pressure |
| T | Temperature |

DETAILED DESCRIPTION OF THE DISCLOSURE

The following is a detailed description of the preferred method of the present invention. It should be understood that the inventive features and concepts may be manifested in other arrangements and that the scope of the invention is not limited to the embodiments described or illustrated. The scope of the invention is intended to only be limited by the scope of the claims that are appended hereto.

The present invention provides a novel heavy oil production method, wherein producer wells are equipped with electric downhole heaters. The heavy oil is heated and produced until pressure is reduced.

At that time, SAGD well pairs are drilled between the DHH wells, and steam injected into both wells until fluid communication is achieved. Then, the lower well is converted to production, and steam is injected only into the injector, and the mobilized heavy oil gravity drains to the lower injection well, where it is produced with an ESP or other artificial lift system. Importantly, the reduction of operating pressure and temperature (P and T, respectively) allow the use of lower temperature steam, thus mitigating risk to the permafrost.

In another method for production of heavy oil, the method comprises providing DHH well(s) in a heavy oil reservoir at a first temperature and a first pressure, said DHH well(s) configured for electric downhole heating using an electric heater cable; heating said DHH well(s) with said electric heater cable during a preconditioning period, thus heating said DHH well(s) to a second temperature. Oil is produced at said DHH well(s) until said first pressure is reduced, thus completing the preconditioning, and the heater can be discontinued, allowing T to also be reduced.

On or around that time, SAGD wellpairs are initiated between the DHH wells, and steam is injected into both wells of the SAGD wellpair until fluid communication is achieved, and then SAGD is initiated by converting the lower well to production and only injecting steam into the upper injector well. The operating P and T for the SAGD wellpair are now lower than would otherwise be required without said preconditioning period, which reduces the risk of melting the surface permafrost.

There could also be some amount of overlap between the end of the conditioning period and the SAGD startup, such that production at the DHH wells continues even during startup.

SAGD continues for as long as possible, and at some later point in time, if desired, the SAGD wellpair can again be converted to steam injection, thus driving the remaining wedge oil to the original DHH wells.

Figure 1:
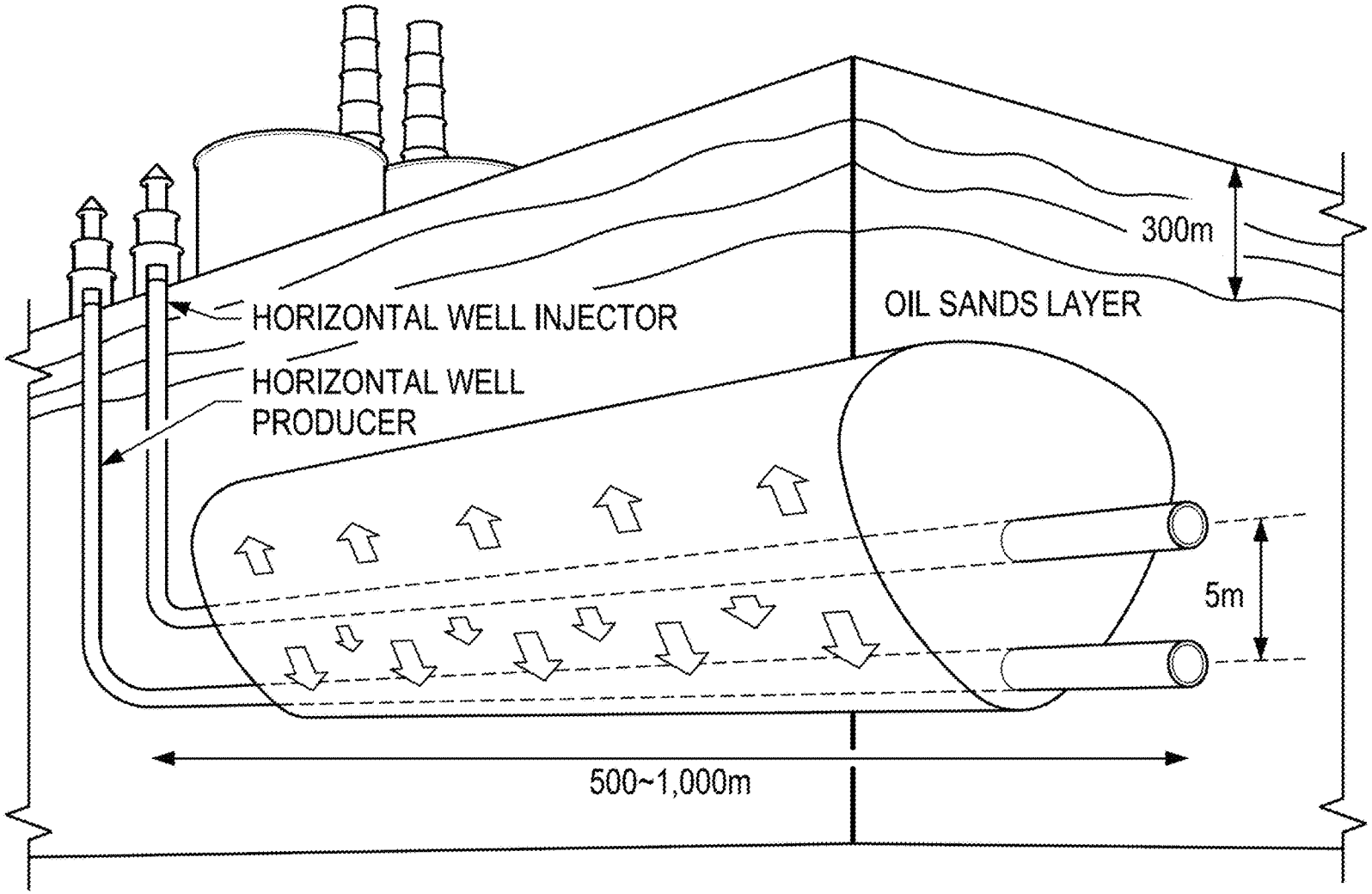
FIG. 1 (PRIOR ART)
FIG. 1 shows a conventional SAGD well pair.
Figure 2:
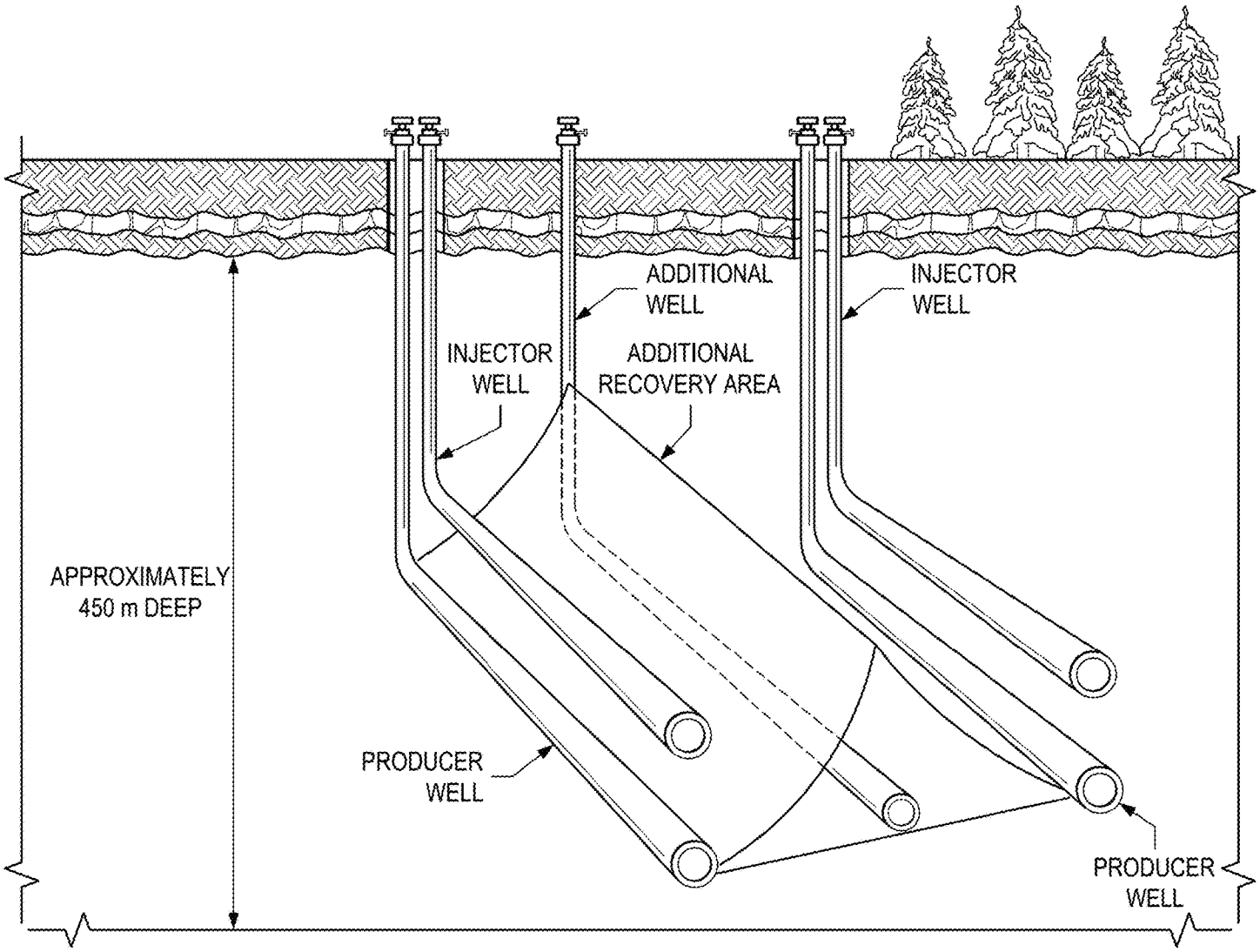
FIG. 2 (PRIOR ART)
FIG. 2 shows the addition of an additional production well between a pair of SAGD well pairs to try to capture the "wedge" of oil between pairs of well pairs that is typically left unrecovered. This midpoint lower well in known as an "infill" well and is typically added once SAGD production wanes.
Figure 3A:
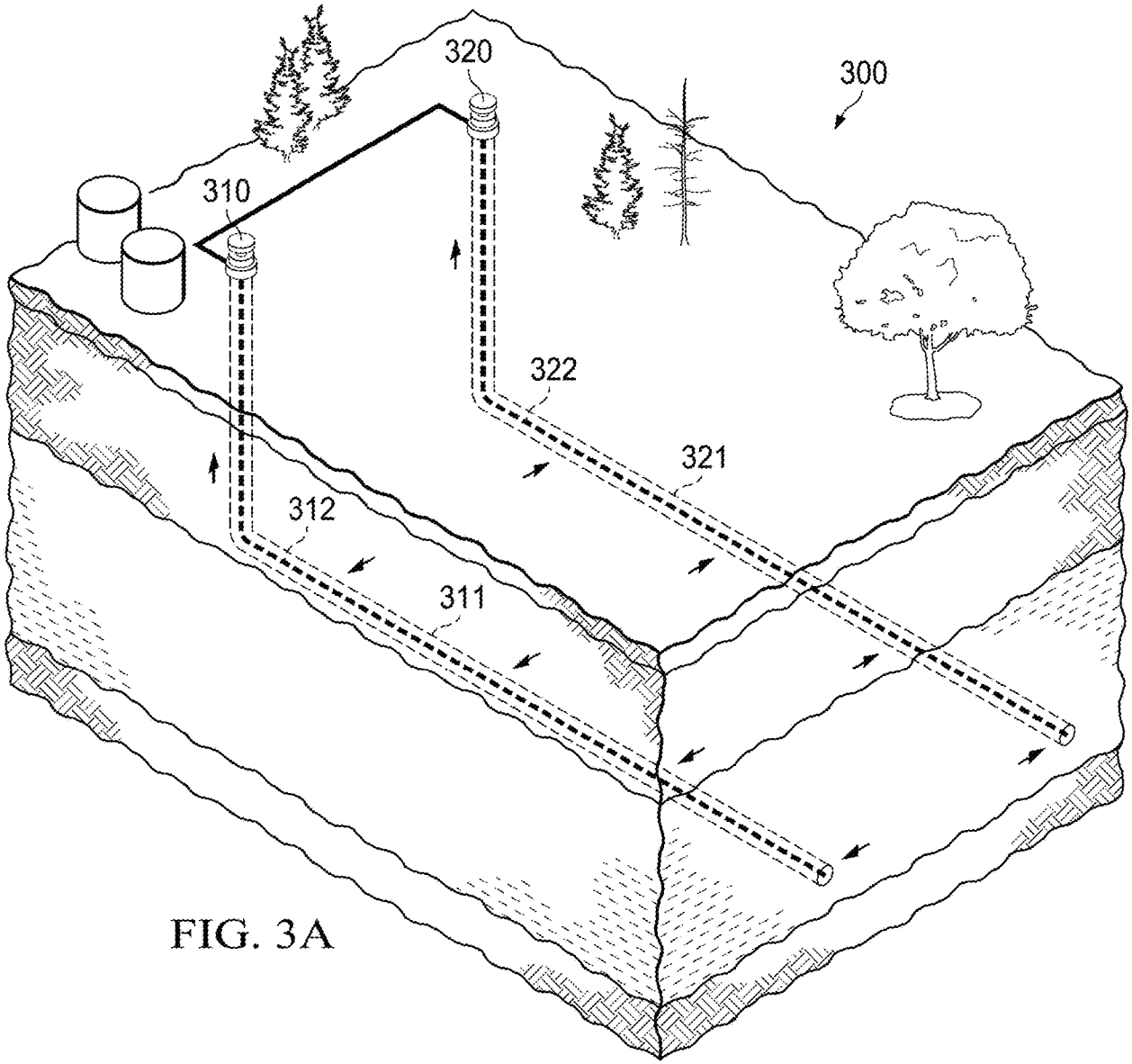
FIG. 3A shows the DHH wells, in this case two, but the pattern can be repeated in an array. Production occurs as the oil is heated by the inline heater until the pressure is reduced.

FIG. 3A shows the original well configuration 300 with DHH wellheads 310, 320 spaced some distance apart, e.g., 50-150 m. The DHH wells 311, 321 are producer wells, e.g., have slotted liners in the production zone, and are equipped with electric inline heaters 312, 322. Oil is produced until the pressure is reduced.

A SAGD well pair is then drilled or if already present, initiated between the DHH wells. These can be traditional SAGD wellpairs or variations thereon. A start-up period will probably be needed to bring these two wells into fluid communication, and typically steam is injected into both wells for a period of time, possibly a reduced period of time, until the wells are in fluid communication. Variation on startup techniques could also be used, e.g., steam and solvent co-injection, steam and gas co-injection and the like.

Figure 3B:
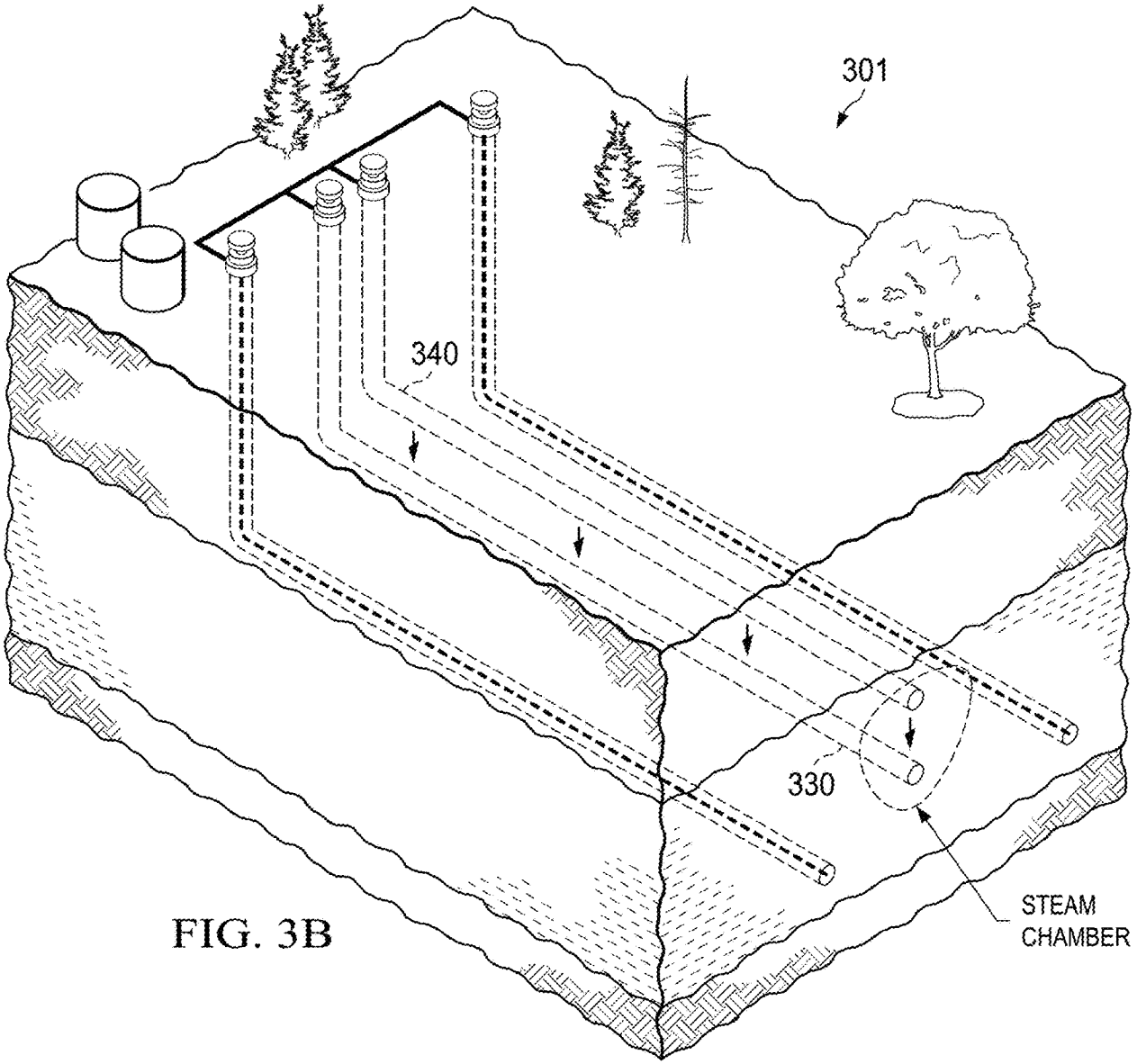
FIG. 3B shows a traditional SAGD well pair added between the pair of DHH wells. In this figure, the wells are already in fluid communication (e.g., after start-up) and steam is being continuously injected into the upper injector well and oil produced at the lower producer using e.g., an ESP to lift the oil to the surface. A typical steam chamber is shown in dotted outline.

Once the SAGD wellpairs are in fluid communication, the lower well 330 is converted to production and steam is only injected into the injector 340, as shown in FIG. 3B. Oil gravity drains to the lower producer well, and is lifted to the surface e.g., with an ESP (not shown), progressing cavity pumps (PCP), hydraulic pumping systems, a rod pump, gas lift, hybrid has lift and rod pump or any other artificial lift mechanism. In deep reservoirs, such as Ugnu, an ESP is typically used due to the depth.

Figure 3C:
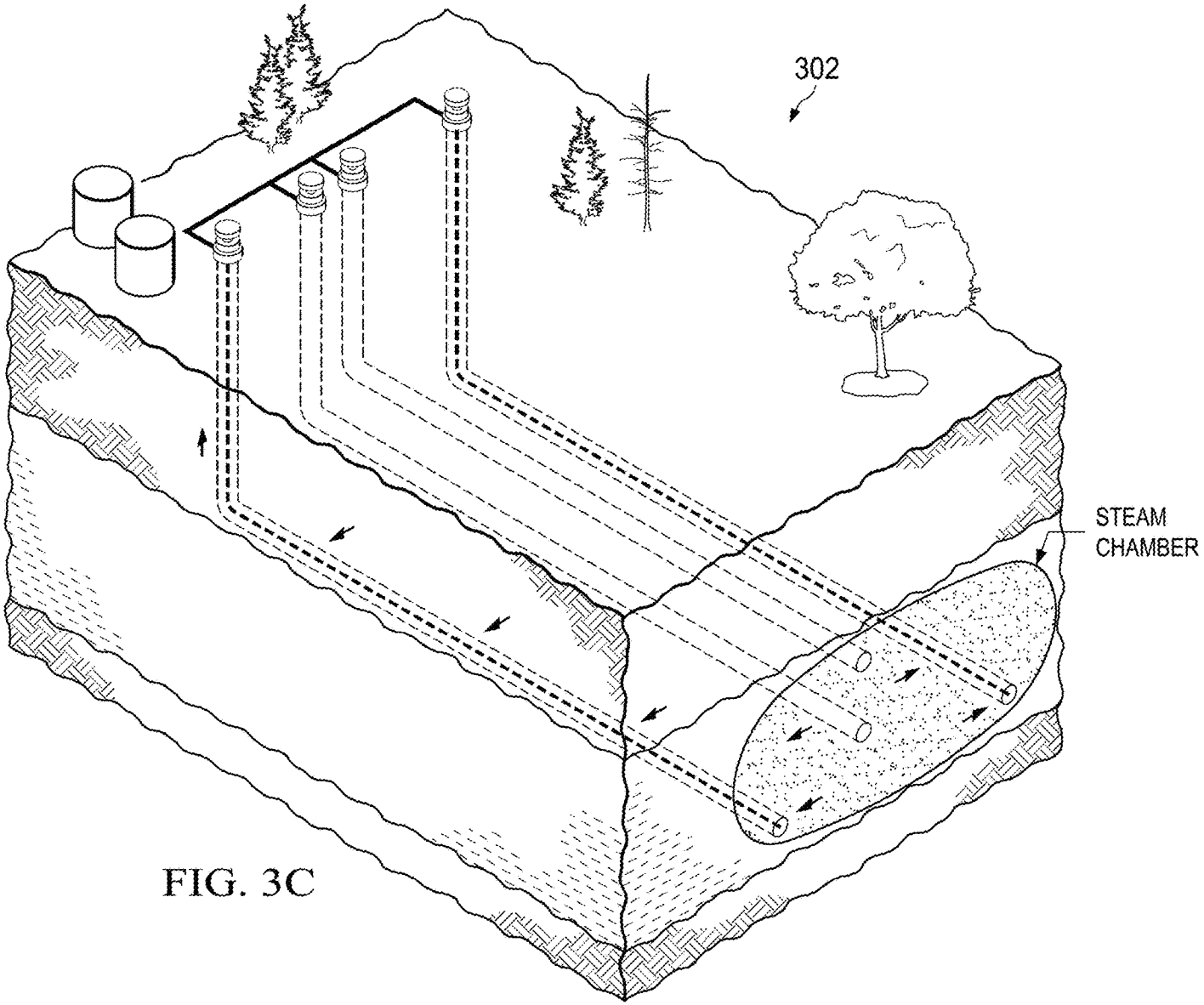
FIG. 3C shows production years later, where, e.g., the remaining oil is driven towards the original DHH wells with steam drive from both wells of the SAGD wellpair.
Figure 4:
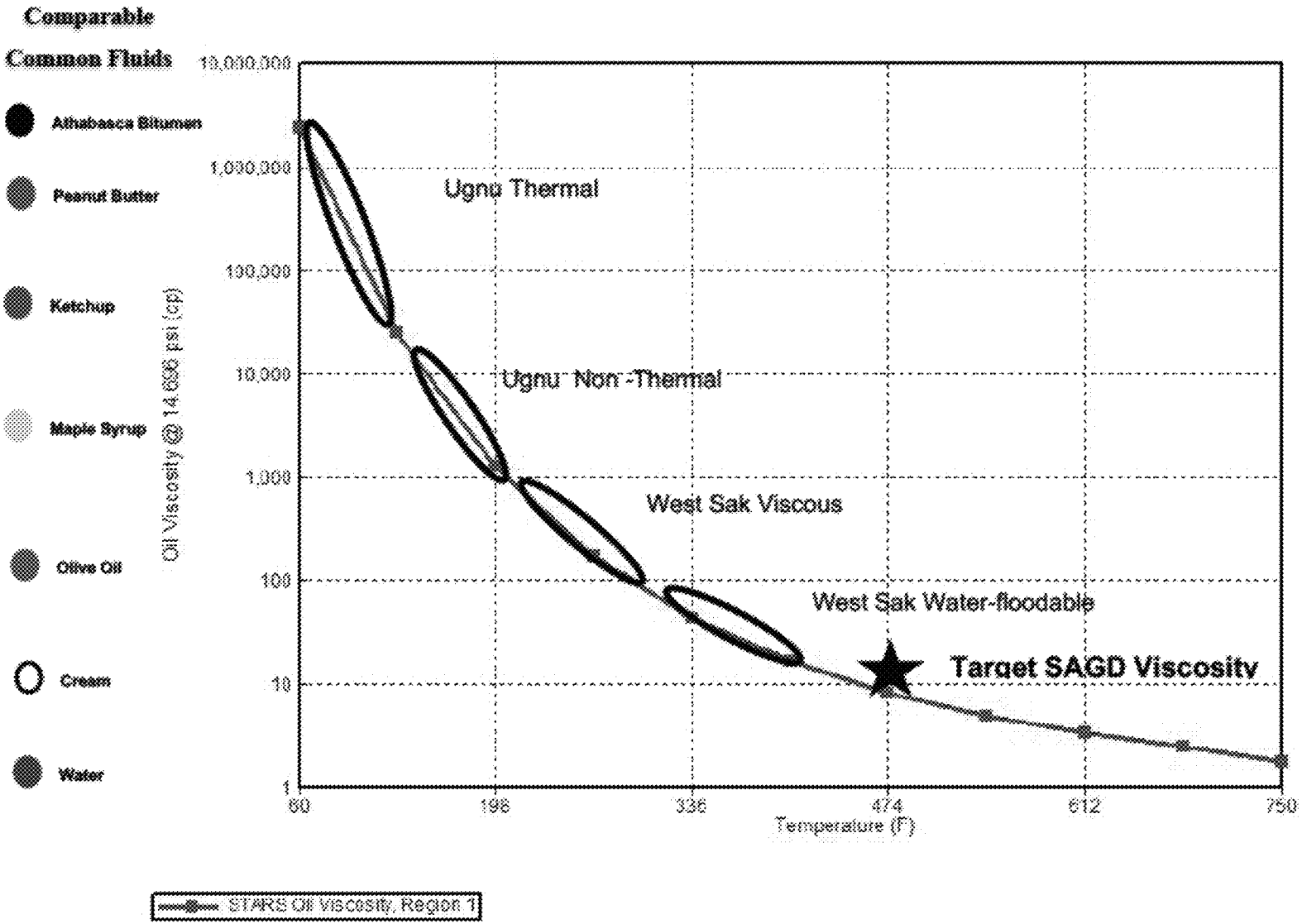
FIG. 4 North Slope Crude Dead Oil Viscosities.

SAGD or a variation on SAGD production will then continue for some period, typically years, and when the play is no longer productive at economical rates, the DHH wells can again be used to capture wedge oil in any method known in the art. Shown in FIG. 3C the SAGD wellpair are again both used for steam injection, thus sweeping oil towards the adjacent DHH wells bracketing the SAGD wellpair. The DHH wells could also be converted to infill wells if the spacing is correct such that the steam chambers from the DHH wells can overlap the steam chamber from the SAGD wellpair.

The following references are incorporated by reference in their entirety for all purposes:

CA2235085 Method and apparatus for stimulating heavy oil production

US20140345861 Fishbone SAGD

U.S. Pat. No. 7,069,993 Downhole oil and gas well heating system and method for downhole heating of oil and gas wells U.S. Pat. No. 6,353,706 Optimum oil-well casing heating U.S. Pat. No. 8,265,468 Inline downhole heater and methods of use US20110303423 Viscous oil recovery using electric heating and solvent injection Rangel-German, et al., "Electrical-heating-assisted recovery for heavy oil," J. Pet. Sci. Eng. 45:213-31 (2004).

The invention claimed is:

1. A method for production of heavy oil, the method comprising:

a) providing one or more horizontal downhole heater production wells (DHH wells) in a heavy oil reservoir at a first pressure, each of said DHH wells configured for electric downhole heating with an electric heater and configured for production of said heavy oil;

b) electrically heating each of said DHH wells and producing said heavy oil for a preconditioning period until said first pressure is reduced to a second pressure, wherein said second pressure is at least 20% less than said first pressure;

c) drilling one or more horizontal wellpairs after said preconditioning period, each of said wellpairs comprising an upper well parallel and over a lower well, each of said wellpairs positioned either beside one of said DHH wells or between a pair of said DHH wells;

d) injecting steam at a first steam injection temperature into said upper well and said lower well of each of said wellpairs until said upper well and said lower well of each of said wellpairs are in fluid communication;

e) converting said lower well of each of said wellpairs to a producer well and injecting steam at a second steam injection temperature only into said upper well of each of said wellpairs; and f) producing said heavy oil at said lower well of each of said wellpairs with steam assisted gravity drainage (SAGD);

wherein said first and second steam injection temperatures are lower than in a method that is the same as said method but without step b.

2. The method of claim 1, further comprising step g) converting said lower well of each of said wellpairs to steam injection and injecting steam into said upper well and said lower well of each of said wellpairs after production from step (f) wanes, thereby steam driving a remaining heavy oil to said DHH wells and producing said remaining heavy oil at said DHH wells.

3. The method of claim 1, wherein said step of electrically heating is discontinued after said preconditioning period.

4. The method of claim 1, wherein said electric heater is an electric heater cable or mineral insulated heater deployed inside said DHH wells.

5. The method of claim 1, wherein said steam injection steps comprise co-injection of steam plus a gas or solvent.

6. The method of claim 1, wherein said DHH wells and said wellpairs are 25-100 m laterally spaced apart.

7. The method of claim 1, wherein said steam injection steps comprise co-injection of steam plus a solvent selected from ethane, propane, butane, pentane or mixtures thereof.

8. The method of claim 1, wherein said steam injection steps comprise co-injection of steam plus a solvent and said solvent is a natural gas liquid condensate produced at said heavy oil reservoir.

9. The method of claim 1, wherein an electric submersible pump is used to lift heavy oil to a surface of said heavy oil reservoir during step f).

10. The method of claim 1, wherein said heating step b) is discontinued in said DHH wells before or during step f).

11. The method of claim 1, wherein said second pressure is at least 30% less than said first pressure.

12. The method of claim 1, wherein said second pressure is at least 40% less than said first pressure.

13. The method of claim 1, wherein said second pressure is at least 50% less than said first pressure.

14. A method for production of heavy oil in a region of permafrost, the method comprising:

a) drilling one or more downhole heater production wells (DHH wells) in a heavy oil reservoir in a region of permafrost, said heavy oil reservoir at a first pressure, said DHH wells each configured for electric downhole heating with an electric heater and for said heavy oil production;

b) electrically heating said DHH wells to reduce a viscosity of said heavy oil and producing said reduced viscosity heavy oil at said DHH wells until said first pressure is reduced to a second pressure, wherein said second pressure is at least 20% less than said first pressure;

c) discontinuing said heating step b);

d) drilling one or more steam assisted gravity drainage (SAGD) wellpairs after step c), each of said wellpairs either beside one of said DHH wells or between a pair of said DHH wells, and producing additional heavy oil with artificial lift and steam based gravity drainage for a SAGD production period until said additional heavy oil production is reduced;

e) injecting steam into both wells of said SAGD wellpairs to drive a remaining heavy oil to said DHH wells and producing said remaining heavy oil at said DHH wells;

wherein the steam is injected at a lower temperature, and thereby a risk of melting said permafrost is reduced, as compared to a method that is the same as said method, but without step b.

15. The method of claim 14, wherein said second pressure is at least 30% less than said first pressure.

16. The method of claim 14, wherein said second pressure is at least 40% less than said first pressure.

17. The method of claim 14, wherein said second pressure is at least 50% less than said first pressure.

18. The method of claim 14, wherein said DHH wells and said SAGD wellpairs are 25-100 m laterally spaced apart.

* * * * *